US005499594A

United States Patent [19]

Bullock

[11] Patent Number: 5,499,594

[45] Date of Patent: Mar. 19, 1996

[54] COLLAPSIBLE TENSION-COMPRESSION VARIABLE HULL STRUCTURE

[76] Inventor: Donald C. Bullock, 31 Logging Hill Rd., Bow, N.H. 03304

[21] Appl. No.: 315,255

[22] Filed: Sep. 29, 1994

[51] Int. Cl.[6] ..... B63B 7/00

[52] U.S. Cl. ..... 114/354

[58] Field of Search ..... 114/352–354, 65 R, 114/123, 343, 56

[56] References Cited

U.S. PATENT DOCUMENTS

| | | | |
|---|---|---|---|
| 244,009 | 7/1881 | Wardell, Jr. | 114/354 |
| 955,020 | 4/1910 | Vaghi | 114/354 |
| 3,497,885 | 3/1970 | Scholle | 114/354 |
| 3,795,926 | 3/1974 | Hoshino | 9/2 C |
| 3,869,743 | 3/1975 | Brown et al. | 114/354 |
| 4,091,485 | 5/1978 | Dohet | 9/2 C |
| 4,282,616 | 2/1981 | Battershill | 9/2 C |
| 4,290,157 | 9/1981 | Jensen, Jr. | 114/354 |
| 4,325,207 | 4/1982 | Russell et al. | 52/641 |
| 4,373,305 | 2/1983 | Russell | 52/86 |
| 4,557,210 | 10/1985 | Gerwin | 114/56 |
| 4,662,297 | 5/1987 | Crowley et al. | 114/61 |
| 4,671,202 | 6/1987 | Johnson | 114/353 |
| 4,730,573 | 3/1988 | Koon | 114/353 |
| 4,779,556 | 10/1988 | Smith | 114/352 |
| 4,911,095 | 3/1990 | Kaye | 114/354 |
| 5,257,594 | 11/1993 | Methven | 114/354 |

FOREIGN PATENT DOCUMENTS

| | | | |
|---|---|---|---|
| 0014530 | of 1913 | United Kingdom | 114/354 |

*Primary Examiner*—Edwin Swinehart

[57] ABSTRACT

A collapsible tension-compression variable hull structure that collapses and stores substantially flat, yet deploys in seconds without additional parts or accessories. The tension boat design is a unique prestressed structure that strengthens the hull, reduces the need for ribs and makes the hull easily collapsible for storage and transport. Basically the present invention in it's most simple form or embodiment is a boat comprised of five simple parts: two hard, slightly flexible sides, a waterproof flexible bottom, a line running from bow to stern, and some method of applying tension to shorten the line. In the storage phase, the boat looks like two thin boards with rumpled waterproof plastic attached to the bottom. The sides bow out like an archery bow when tension is applied shortening the line. The exact beam or width of the boat depends on the amount of tension on the line. Additionally, the use of multiple tension members running through guides located off the center line of the vessel allows for most aspects of the hull shape to be trimmed and altered even while the vessel is underway. There are many optional formats for such a boat including use as a dingy, a canoe, a sailboat, or a pram, or other different variations which can be built from the same basic idea.

3 Claims, 3 Drawing Sheets

COLLAPSIBLE TENSION-COMPRESSION VARIABLE HULL STRUCTURE

BACKGROUND OF THE INVENTION

1. Field of the Invention

This invention most generally relates to an easily deployable and collapsible, portable tension boat, and even more particularly to a boat which can be stored flat until ready for use, then, by means of shortening a tension line connecting the bow and stern, be expanded within seconds to a boat ready for use, as well as a boat which can have its shape altered while underway in the water.

2. Description of the Prior Art

Small boats are quite often transported to and from the water where they are used. Boats which are collapsible, easily assembled, or inflated are popular with fishermen, people with larger moored boats, and recreational boaters because they are easier to carry and store. However, certain problems are created with most of the choices available.

Inflatable boats are collapsible for compact storage but require a considerable time and effort for inflation at the site at which they are to be used. Typically, foot pumps are necessary accessories for such inflatable boats, but even with a foot pump, considerable time and a great deal of effort is required to inflate such a boat for use. Furthermore, flexible hulled boats exhibit a tremendous drag in the water.

U.S. Pat. No. 3,795,926 by Hoshino teaches a lightweight metal frame that a one piece sheet can be pulled over to form a hull. Setting up time can take awhile. After being in the water, the sheet should be hung out to dry requiring more time and space at home. U.S. Pat. No. 4,282,616 by Battershill teaches a rigid, collapsible boat with a plurality of hull sections that are laced together. U.S. Pat. No. 4,557,210 by Gerwin and U.S. Pat. No. 4,662,297 by Crowley et al. teach versions of knock-down boats that can be assembled at dockside from a plurality of parts. The loss of one part can make assembly impossible. A part left at home or in storage can cancel a day's outing.

Many of the prior patents teach a system whereby the boats are divided into sections which are joined together to form a boat. Usually each section of the boat is a version of an irregular shaped box without a top and then joined together with a unique method. U.S. Pat. No. 4,671,202 by Johnson teaches such a boat that forms a towable trailer when wheels are added or forms a box that can be attached to a motor home. U.S. Pat. No. 5,257,594 by Methuen teaches a folding boat that forms a suitcase when it is compact. Storage still requires a three dimensional space.

There are two collapsible boats that use tension to create the boat. U.S. Pat. No. 4,091,485 by Dohet teaches a boat created by extending laterally rigid ends longitudinally by a universal joint. U.S. Pat. No. 4,730,573 by Koon teaches a foldable flat boat that uses internal parts to form bulkheads that give the boat a third dimension.

Many times, the construction of a knock-down boat is such that the sections cannot be assembled in the water, thereby defeating many of the potential advantages of a disassemblable boat since room must be available in which to assemble it and sufficient personnel or equipment must be available to lift it into the water after it has been assembled. Obviously, a boat which requires time-consuming out of the water assembly is entirely unsuitable for use as a life raft. U.S. Pat. No. 4,779,556 by Smith teaches assembly of a boat cut in sections with a bulkhead between each section. An advantage of such a design is that it can be assembled in the water. However, the boat still needs a three dimensional storage area and has loose parts to loose or leave behind or be dropped in the water.

All of these fail to provide a small, extremely lightweight storage package that takes practically no room for storage. Even those that fold up as small as a suitcase need a sizeable three dimension space for storage. When a boat is used as a dingy to reach a moored boat, storage space is critical and in short supply if it is to go with the moored boat.

None of the discovered prior art boats could provide adjustments in the shape of the boat while under way. A fisherman may want to have a slim speedy boat to reach the fishing spot, yet want a wider, more stable boat to spread out his tackle while he is fishing. Many of the prior art take time to assemble. Some have parts that can be lost or left back at home and not discovered until at dockside. None of them function for anything other than a boat. They have no second capability that comes in handy for weekend explorers or campers who are limited as to the amount of gear they can carry.

It would be desirable and advantageous to have a boat that is easy to deploy and take down. It would also be desirable and advantageous if that boat were easy to store while not in use either on land or on a larger boat while under way. It would be an additional advantage to have an improved strength to weight ratio for such a boat. A further advantage of the invention is the ability to change aspects of the boat while underway in the water. Yet another advantage is to have a boat deployable while in the water without extra accessories.

The patents noted herein provide considerable information regarding the development that have taken place in this field of technology. Clearly, the instant invention provides many advantages over the prior art inventions noted above. Again, it is noted that none of the prior art meets the objects of the tension boat in a manner like that of the instant invention. None of them are as effective and efficient for a compact, quickly deployable boat as the tension boat.

SUMMARY OF THE INVENTION

Basically the present invention in it's most simple form or embodiment is a boat comprised of five parts: two hard, slightly flexible sides, a waterproof flexible bottom, a line running from bow to stern, and a means of applying tension to shorten the line. In the storage phase, the boat looks like two thin boards with rumpled waterproof plastic attached to the bottom. The sides bow out like an archery bow when tension is applied shortening the line. The exact beam or width of the boat depends on the amount of tension on the line. The bottom is cut from any of a series of waterproof flexible plastics roughly the length of the boat when collapsed and the width of the boat when it is fully spread. All seams are waterproof and created by either adhesive or a locking molding over the chimes or both. With rubber molding on the chimes and gunwales, the boat, in either collapsed or deployed mode, can be placed between the hull and any object that may potentially gouge or damage the hull.

There are many alternatives for such a boat. Many of them depend on what the ultimate use will be. The length can vary from 8 to 20 feet, but has no limit. Smaller than eight feet may be considered a model. Since the boat can be used as a dingy, a canoe, a sailboat, or a pram, different variations can be built from the same basic idea. The intended use can make a difference also. A hunter or fisherman would want a smaller version as would someone running back and forth to their larger moored boat. The smaller a boat is, the easier to store.

Clearly, the tension boat may have a variety of configurations and may be made from a variety of materials. For example, the longer a boat is, the thicker the sides must be to facilitate arching, but not buckling, that is, a double, "S," or "W" bend in the material. As an example, a eight foot boat could be made using quarter inch marine plywood. However, quarter inch plywood would be much too flimsy for an 18 foot boat. It is desirable that the hull material be substantially lighter than water to provide floatation in case of capsizing.

Other alternatives include adding one or more tension lines which would allow for better control of the shape of the boat. The line or lines can be moved away from the center of the boat. The line or lines can go along the sides or along the bottom most of the length of the boat, but not the entire length. This design varies aspects of the shape such as the rocker, flare, beam, and buoyancy.

The means for shortening the tension lines are many. The line can be in a slip knot and just pulled by the seaman to shorten. A clip can be used like on the tents to keep the lines taut. A rachet can be employed. Cross members can be inserted under the line and placed on the gunwales.

The material for the sides offer several alternatives. Several plastic-foam-plastic sandwich materials would offer the combination of strength, light weight, and floatation which is a desirable property in a boat. Plastics add the advantage of being available in an assortment of colors.

The main advantage of a boat of this design is the ease of deployment. The boat is placed either on the ground or in the water. The tension line shortened and in five seconds or less the boat is ready. Collapsing the boat only requires the release of the tension and the boat is flat. If the boat becomes swamped while in the water, the user can get out, collapse the boat which will force out most of the water in seconds, re-tension the line, and get back in the boat with only an inch or less of water remaining in the boat. The remaining water can be sponged or bailed out in short time for a dry boat.

An added advantage is that a single boat could meet different needs by changing the beam and displacement in the water. When a greater load is to be carried, whether more people or just a months groceries to the moored boat, the boat can be opened up further to have more displacement. When speed is of more concern, the boat is opened less to allow for better passage through the water.

An advantage of this design is that weight on the tension member will also open the boat. Thus, when a seat on the tension member is pushed down, the boat will spread open. This feature has other uses. If the load to be carried by the hull, such as an airplane wing pontoon, is loaded on the tension member, then the hull will automatically expand to provide additional buoyancy under increasing loads and conversely slim to a streamline shape when the load is decreased or eliminated such as on takeoff.

Another advantage of the boat is the ease of storage when the tension boat is collapsed. In its collapsed state, the boat requires no more room than a little more than twice the width of one of its sides. It would be as easy to store as a 2 by 12 inch board which is as long as the boat is long, but at about one-third the weight. This means someone using an RV could place the collapsed tension boat on top and secure it before leaving. Someone using it as a dingy to reach their larger moored boat could store it below, hang it from a safety line stanchion, or use it as a bumper pad while under way. At home, it could be stored in the rafters, along a wall or anywhere an 8 to 18 foot 2 by 12 inch board could be stored. A hunter, camper, or fisherman could pull it up on shore, turn it over and use it for a hammock or cot for the night. This serves the additional function of allowing one or fewer items, such as a cot, to be carried on the trip. The tension boat can also be used for a bunk, wind-protected hammock, solar water heater, and, in connection with a clear plastic cover, distill sea water.

An advantage of a design such as this is the absence of ribs. There is a substantial weight savings without utilizing ribs. Also, the production costs are reduced due to fewer basic parts and less labor required for assembly. There are structural advantages as well. When the tension boat is open, the sides of the hulls are in column stress, i.e., the outer surfaces are in tension and the inner surfaces are in compression. This arrangement provides a condition where any forces directed inward against the hull is resisted by the entire hull resulting in an increase of tension on the inner cable. Thus, these inwardly directed forces such as water pressure actually reduce the tension stresses on the side hulls and increase the potential energy in the center cable.

Another advantage of a boat of this design is the ease in shipping. Manufacturers of small boats spend a great deal of money on shipping to customers and retailers. A sizeable percentage of the purchase price of each boat contains shipping costs. It is conceivable that a 40 foot trailer could carry over 500 tension boats 12 feet long at one time.

These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

The following is a description of the preferred embodiment of the invention. It is clear that there may be variations that are not discussed in the size and the shape of the apparatus, in the materials used in the construction, and the orientation and placement of some of the components of the boat. However, the main features of the tension boat are consistent and are: a boat which deploys or collapses in a matter of seconds by adjustment of the tension member on land or in the water, a boat which stores substantially flat because of its almost two dimensional storage profile, a boat which has an improved strength to weight ratio, and a boat which possess an ability to change aspects while underway in the water.

Figure 1:
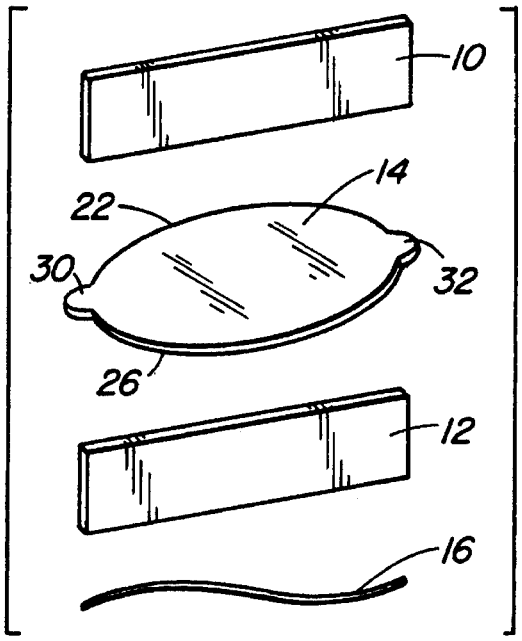
FIG. 1 is an exploded view of the collapsible tension-compression boat.
Figure 2:
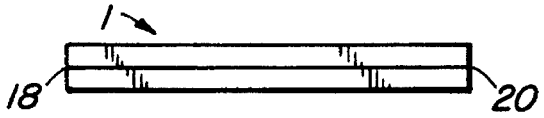
FIG. 2 is a top view of the invention collapsed.
Figure 3:
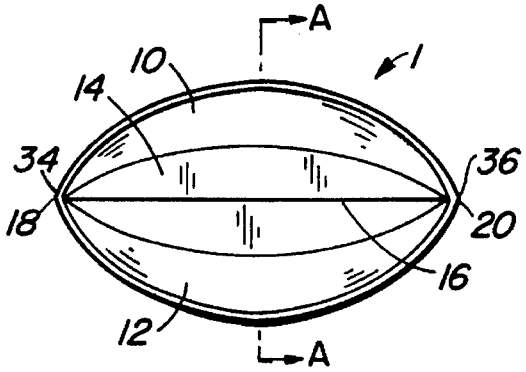
FIG. 3 is a perspective view of the invention in a deployed state.

Reference is now made to FIG. 1 which illustrates the preferred embodiment of the tension boat 1 in an exploded view in its simplest form: a starboard side 10, a port side 12, bottom 14, and a tension member 16. FIG. 2 shows the tension boat 1 assembled and in its collapsed state ready for storage or stowing on a moored boat or motor home. FIG. 3 also shows an assembled tension boat 1, but in a deployed ready-to-use format.

Assembling the tension boat 1 begins by joining the two sides 10 and 12 at the bow chime 18. The hulls 10 and 12 are next joined at the stern chime 20. The bottom starboard side 22 is attached to the side 10 at the starboard chime 24. The bottom port side 26 is attached to side 12 at the port chime 28. The bottom bow end cap 30 is brought up and over and attached to the bow chime 18. The bottom stern end cap 32 is brought up and over and attached to the stern chime 20. All attachments are made in a waterproof manor, preferably with a waterproof adhesive. The end caps are optional. The tension member 16 is stretched from the bow attaching point 34 to the stern attaching point 36 and attached at both ends. In the preferred embodiment, the tension member is tied in a knot 38.

To use the tension boat 1, shorten the tension member 16 and tie the knot making the tension member shorter and the sides 10 and 12 spread apart as shown in FIG. 3. Release the knot to collapse the tension boat 1 for storage or transportation.

Figure 4:
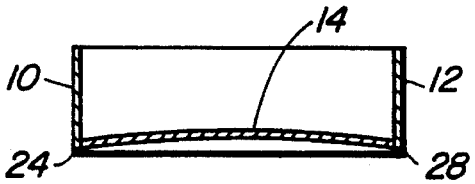
FIG. 4 is a cross section of a flat bottom embodiment.
Figure 5:
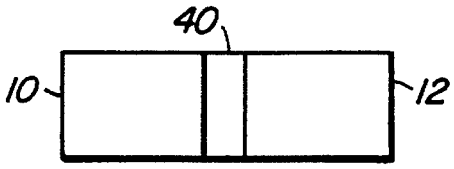
FIG. 5 is an end view of a flat bottom embodiment.
Figure 6:
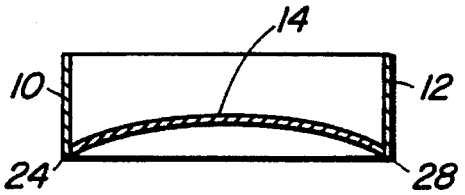
FIG. 6 is a cross section of an embodiment with a slight tunnel.
Figure 7:
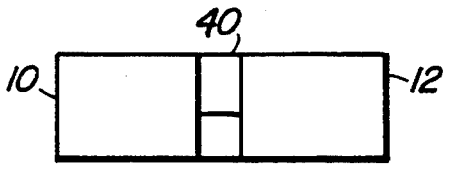
FIG. 7 is an end view of an embodiment with a slight tunnel.
Figure 8:
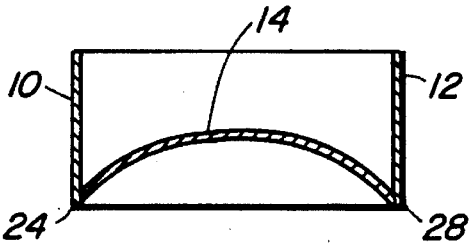
FIG. 8 is a cross section of a double keel or tunnel bottom.
Figure 9:
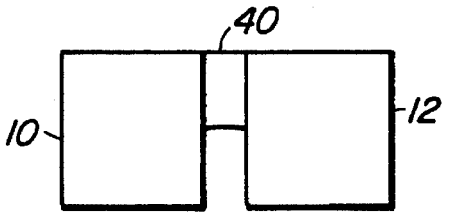
FIG. 9 is an end view of a double keel or tunnel bottom.

An alternative way of assembly is to insert a bow stem 40 between the bow ends of sides 10 and 12. FIG. 4 shows a cross section of the preferred embodiment of the tension boat 1. FIG. 5 shows the end view of the same embodiment which has a bow stem. FIG. 6 shows a cross section of a slight tunnel embodiment. FIG. 7 shows the end view of the same embodiment. Note that the bow stem 40 is slightly shorter than the sides 10 and 12. FIG. 8 shows a cross section of a double keel or tunnel bottom. FIG. 9 the end view of the double keel or double tunnel bottom embodiment. Note here that the bow stem 40 is significantly shorter than sides 10 and 12. This embodiment would be ideal for a sailboat or lake canoe where a keel or centerboard is necessary to hold a line while underway.

Boats made as sailboats or for lake canoes need a larger keel. The joint or chime at the bottom of the boat can be wider and serve as a good size keel. A 16 foot boat with twin 16 foot by 4 inch keels would be the same as a single keel of over 10 square feet. Boats to serve more neutral uses could have a shorter seam.

Figure 10:
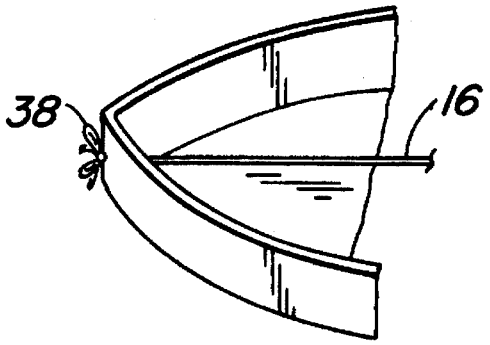
FIG. 10 is a cut-away view showing the tension member connected at the bow.
Figure 11:
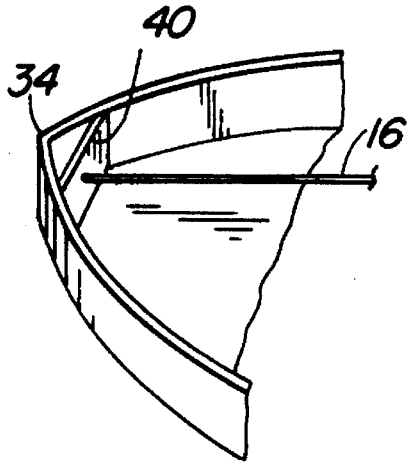
FIG. 11 is a cut-away view showing the use of a bow stem.
Figure 12:
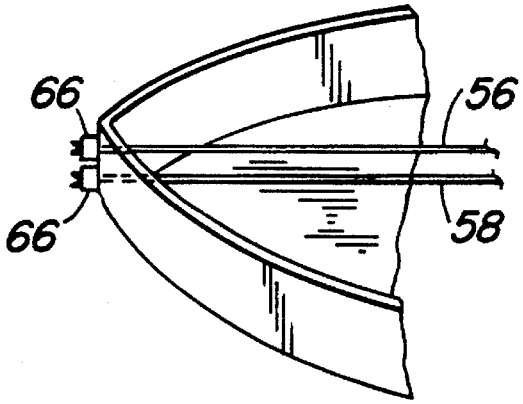
FIG. 12 is a cut-away view showing double tension members.
Figure 13:
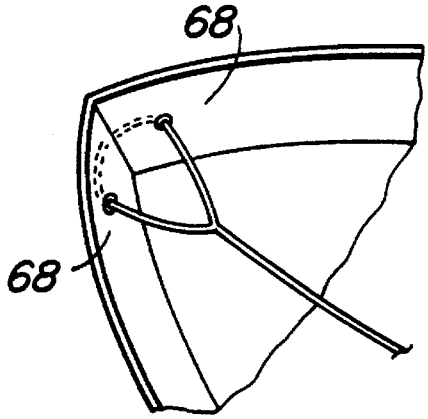
FIG. 13 is a top view showing a "V" line tension member.

Attaching point 34 at the bow and its counter-point attaching point 36 at the stern can be manifested in a variety of ways. The simplest is shown in FIG. 10 where a hole allows tension member 16 to be threaded through and simply tied in a knot. FIG. 11 shows the use of a bow stem. The tension member 16 can also be tied around a block as well. FIG. 12 shows blocks 66 being used for twin tension members 16. FIG. 13 shows an attaching point that is set away from the bow chime 18 to twin points 68 a few inches back on the sides and using a loop to secure the tension member 16.

Figure 14:
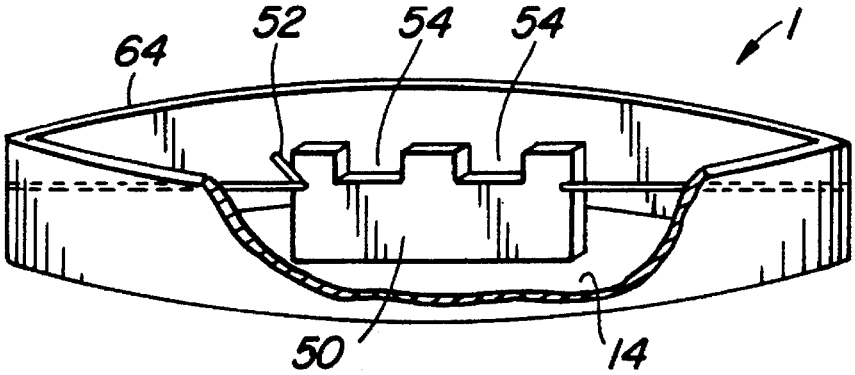
FIG. 14 is a cut-away showing a solid tension member in place.

FIG. 14 shows a cut-away side view of an embodiment where most of the tension member is replaced by a solid tension member 50. There are several advantages of a solid tension member. The solid tension member 50 will sit on the bottom 14 and act as an inside keel pushing on the bottom 14 to create a V-shaped hull. The remaining tension members 16 at each end can be shortened by a locking lever 52 attached to the end of the solid tension member 50. Seats can be added where the cuts 54 are shown in the solid tension member 50.

Figure 15:
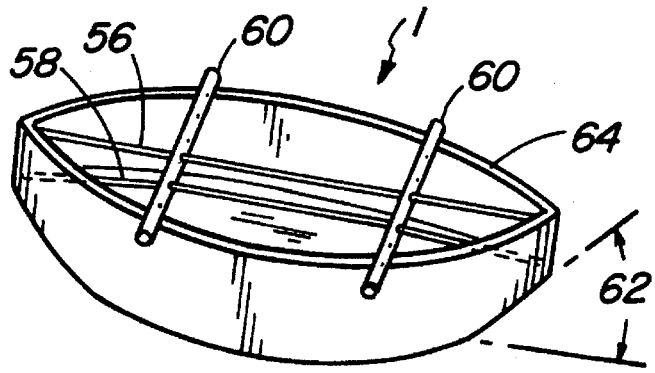
FIG. 15 is a perspective view of an embodiment with two tension members and a cross member.
Figure 16:
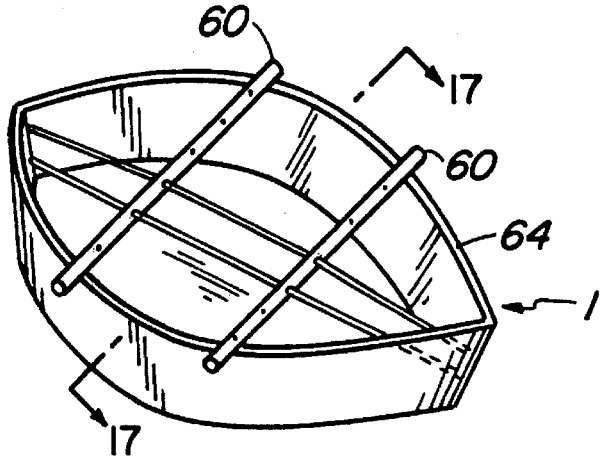
FIG. 16 is a perspective view showing the result of different tension on the tension members.
Figure 17:
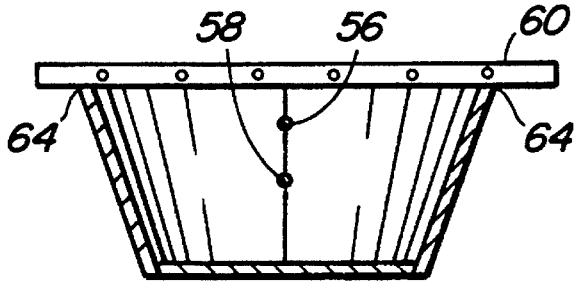
FIG. 17 is a cross section of FIG. 16.

FIG. 15 shows a tension boat with double tension lines 56 and 58 and cross-members 60 used to tighten the tension members 56 and 58. When both tension members 56 and 58 are pulled up to the gunwale height and pushed to one side, the bottom tension line 58 is shortened more than the top tension line 56. Therefore, if more tension is to be placed on the top member 56, the top member 56 must be tighter in the beginning than the tension on the bottom tension member 58. Note that when the top tension member 56 has relatively more tension in the open phase, a rocker 62 at the end as shown in FIG. 15. FIG. 16 shows the result of higher tension on the upper tension member 56, maximum hull flare and reserve buoyancy. FIG. 17 shows a cross section of FIG. 16 to show the flare.

Figure 18:
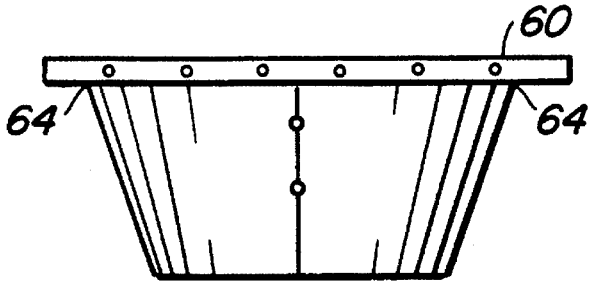
FIG. 18 is a detail of a cross member.

FIG. 18 shows a detail of a cross-member 60 sitting on the gunwales 64. The cross-member can have a variety of forms. The lines can sit on top in grooves on the cross-member, can go underneath on hooks or eye-bolts attached to the cross-member, or can be threaded through holes in the cross-member. The advantage is that the tension members 56 and 58 can be moved to the sides away from the center of the boat. As show above, this movement can affect the shape of the boat as well.

The obvious alternatives to building the tension boat 1 are the materials to be used in the construction. As stated before, the longer the boat, the stiffer the material must be to prevent buckling or forming an "S" or "W" curve on the side. Acceptable materials are foam-core plastic such as Royalite® sold by Royalite, Thermo-plastics Division, Poly Technology Corporation, P.O. Box 568, Misawaka, Ind., 45646-0568. Other materials such as plastic, composite fabric and resins, fiberglass, Kevlar®, aluminum, wood, a skin frame, or fabric on frame would also work. Another possibility is using combinations such as wood and canvas, wood and fiberglass, laminates, or foam cored laminates.

The sides can be made of a material such that the flexibility varies throughout the side. This would be another method of adjusting the aspects of the tension boat. For example, the relative thickness of the material forming the sides can be varied as well to have different results. For instance, if the bottom part of the sides is thicker than the top part of the sides, similar to a trapezoid in a cross section, there would be more flare since the top would not be as stiff as the bottom and would flare out more than the part below the water line. The thickness could vary from front to back, also. A relatively thicker side at the bow end could result in a sharper pointed bow and a more rounded stern.

The chimes and gunwales can be covered with an optional rubber locking molding to prevent scratching another boat or carrier such as a car roof. With rubber molding on the chimes and gunwales, the boat, in either collapsed or deployed mode, can be placed between the hull and any object that may potentially gouge or damage the hull.

The bottom 14 can also be a variety of materials as long as it is waterproof and slightly stretchable longitudinal. Some examples of what the bottom can be are composite flexible materials of the base fabrics of nylon, Hypalon®, neoprene with coatings of ethylene propylene-diene monomer, polyvinyl chloride, polyester, or urethane.

The tension member offers a wide variety of options for materials such as a metallic cable, nylon, Dacron®, polypropylene, polyester, rope, cotton, manila, jute, sisal, or a combination of the above. The member can also be solid adjustable material such as piping, tubings, plank, post, laminate, composite, or beam. The means for shortening tension member 16 present more diverse alternatives. Simply pulling the tension member by the user and tying it has already been mentioned. Also, a tent line chock, locking lever, rachet, come-along, wedge, cam, jack, screw, pulley, turnbuckle, spring, clamp, belt, winch, chain fall, or a block and tackle can be used. The length and nature of the tension boat may dictate which of the above are the most appropriate for that particular model.

Many of the decisions about materials for the different parts of the tension boat, the length, whether to have one or multiple tension members, bow stem type, and transom type depend on the ultimate intended use. The tension boat can be used as a canoe for a camper or fisherman. The boat can be fitted for and used as a sail boat. A locking molding of soft rubber material on the gunwales and chimes would be important for a dingy so it would not scratch another hull.

The use of multiple tension members running through guides located off the center line of the vessel allows for most aspects of the hull shape to be trimmed and altered even while the vessel is underway. As was discussed above, the rocker can be adjusted as well as the buoyancy, the beam, and the flare.

A bow stem can be included as mentioned above. The stem can act merely as a thin board where the two bow ends of the sides attach. It will also give more strength to the boat at the bow. The wider the bow stem, the more it approaches a pram shape and slows down the progress in water. The same is true for a transom except it will not impede progress. Another advantage of a transom is that a small motor can be attached.

The weight of a tension boat will depend on the length, construction materials, and intended use. A rugged 12 foot model capable of withstanding moderate rapids or rowdy teen-agers may weigh approximately 35 pounds or less. A lightweight model can be constructed by using only a frame structure for the sides. The side would then be covered with a lightweight material, such as a rip-stop waterproof nylon, and sealed. This embodiment may weigh in at less than 15 pounds. However, such a model may not withstand the sharp rocks encountered in a run through rapids.

The light weight of 35 pounds or less would enable a single person to carry the collapsed boat under one arm alone. Portages around obstacles or falls would no longer be dreaded by canoers.

The tension boat could be used in catamarans or trimarans as the main hull or as pontoons or sponsons. The big advantage with these type boats would be ease of carrying, deploying, and storage.

Another design feature is that weight on the tension member will also open the boat. Thus, when a seat on the tension member is pushed down, the boat will spread open. This feature has other uses. If the load to be carried by the hull, such as an airplane wing pontoon, is loaded on the tension member, then the hull will automatically expand to provide additional buoyancy under increasing loads and conversely slim to a streamline shape when the load is decreased or eliminated such as on takeoff.

The importance of the compact size of the tension boat when collapsed cannot be overstated. A representative semi-tractor trailer measures approximately 40 feet long by 110 inches high by 7 feet wide. A 13 foot tension boat measures less than 2 inches thick when collapsed. The sides are approximately one-half inch thick each and the rumpled bottom is less than an inch thick. The sides are approximately 18 inches or less high. Therefore, the boats could be stacked 50 high leaving 10 inches extra, 3 deep leaving a foot extra, and 4 wide leaving and extra foot or a total of 600 boats to a trailer. Allowing room for pallets and minimum shipping wrap, it is still conceivable to ship over 500 boats 13 feet long in one shipment. The real significance of this feature is the savings in cost to the consumer. A standard 13 foot canoe could be stacked no more than 5 or 6 high, 2 wide, and 3 deep or a total of no more than 36 boats in the same size tractor-trailer. That means the shipping cost of a tension boat the same size is about 14 or 15 times cheaper. This savings can be significant. A moving company typically charges an extra $200 to move a canoe with the rest of the furniture.

An outing by a group such as the scouts or a Y-group always need a specially designed trailer with canoe racks to carry the six to eight canoes for a day outing. The trailer has no other use and sits for the rest of the year. If there are more canoes than places on the racks, multiple trips must be made.

There are many non-boat uses as well for the invention. The inventor believes that it is always preferable for an item to have more than one use. The unique hard side-soft bottom concept allows other uses. The tension boat can be used as a cot, bunk, or hammock when open and upside down. It can be used as a solar hot water heater. It can also be used to distill sea water with a clear plastic cover.

It is thought that many of the attendant advantages will be understood from the foregoing description and it will be apparent that various changes may be made in the form or geometry of the tension boat, in the size, the construction, arrangement, and materials used for the parts thereof without departing from the spirit and scope of the invention or sacrificing all of its material advantages, the form hereinbefore described being merely a preferred or exemplary embodiment thereof.

I claim:

1. A collapsible hull having an adjustable hull shape comprising (a) two hull sidewalls constructed of bendable sheets of material connected and sealed at the bow and stern end portions of the hull, (b) said sidewalls being connected and sealed to a bottom constructed of a flexible and waterproof material, (c) at least one elongate and adjustable tension member attached to and extending between the bow and stern end portions of the hull, (d) means for increasing or decreasing the tension of said at least one tension member, whereby the hull width is increased by increasing the tension in said at least one tension member, the hull width and tension being adjustable over a wide range.

2. A collapsible hull having an adjustable hull shape according to claim 1, further comprising a topside of the hull being enclosed by a flexible waterproof material, whereby said hull functions as a pontoon.

3. A collapsible hull having an adjustable hull shape according to claim 1, further comprising a relatively rigid yet bendable frame covered by waterproof material for the sidewalls.

* * * * *